United States Patent [19]

Yamamoto et al.

[11] Patent Number: 4,703,537

[45] Date of Patent: Nov. 3, 1987

[54] CLEANING APPARATUS FOR STIMULABLE PHOSPHOR SHEET

[75] Inventors: Takaaki Yamamoto; Kaoru Tamura, both of Kanagawa, Japan

[73] Assignee: Fuji Photo Film Co., Ltd., Japan

[21] Appl. No.: 749,756

[22] Filed: Jun. 28, 1985

[30] Foreign Application Priority Data

Jul. 4, 1984 [JP] Japan ..... 59-138740

[51] Int. Cl.[4] ..... B08B 11/00

[52] U.S. Cl. ..... 15/102; 15/77

[58] Field of Search ..... 15/77, 100, 102

[56] References Cited

U.S. PATENT DOCUMENTS

| | | | |
|---|---|---|---|
| 1,454,703 | 5/1923 | Cohen | 15/100 |
| 3,098,249 | 7/1963 | Tice et al. | 15/102 X |
| 3,440,675 | 4/1969 | Yeaman | 15/102 X |
| 3,562,834 | 2/1971 | Stievenart et al. | 15/100 |
| 3,694,071 | 9/1972 | Touchette | 15/100 X |
| 3,792,503 | 2/1974 | Brock | 15/102 X |
| 4,303,330 | 12/1981 | Hehn et al. | 15/100 |

OTHER PUBLICATIONS

IBM Technical Disclosure Bulletin, Tape Cleaner; vol. 9, No. 3, Aug. 1966.

*Primary Examiner*—Edward L. Roberts
*Attorney, Agent, or Firm*—Gerald J. Ferguson, Jr.; Michael P. Hoffman; Michael J. Foycik, Jr.

[57] ABSTRACT

A cleaning apparatus for removing dust sticking to the surface of a stimulable phosphor sheet used for recording a radiation image comprises first sheet conveying rolls for conveying the stimulable phosphor sheet, and a rotatable cleaning roll provided with a cleaning member for catching dust around the circumferential surface and positioned for contact with the surface of the stimulable phosphor sheet conveyed by the first sheet conveying rolls. The apparatus also comprises a plurality of guide rolls for guiding the stimulable phosphor sheet so that it contacts in the bent form with the circumferential surface of the cleaning roll, and second sheet conveying rolls for conveying the stimulable phosphor sheet coming from the cleaning roll.

21 Claims, 5 Drawing Figures

CLEANING APPARATUS FOR STIMULABLE PHOSPHOR SHEET

BACKGROUND OF THE INVENTION

1. Field of the Invention

This invention relates to a stimulable phosphor sheet cleaning apparatus for removing dust from the surface of a stimulable phosphor sheet used in a radiation image recording and reproducing system wherein the stimulable phosphor sheet is exposed to a radiation to have a radiation image stored therein and is then exposed to stimulating rays which cause the stimulable phosphor sheet to emit light in proportion to the stored radiation energy, the emitted light is detected and converted into an electric image signal, and a visible image is reproduced by use of the electric image signal.

2. Description of the Prior Art

When certain kinds of phosphors are exposed to a radiation such as X-rays, $\alpha$-rays, $\beta$-rays, $\gamma$-rays, cathode rays or ultraviolet rays, they store a part of the energy of the radiation. Then, when the phosphor which has been exposed to the radiation is exposed to stimulating rays such as visible light, light is emitted from the phosphor in proportion to the stored energy of the radiation. A phosphor exhibiting such properties is referred to as a stimulable phosphor.

As disclosed in U.S. Pat. Nos. 4,258,264, 4,276,473, 4,315,318 and 4,387,428, and Japanese Unexamined Pat. Publication No. 56(1981)-11395, it has been proposed to use a stimulable phosphor in a radiation image recording and reproducing system. Specifically, a sheet comprising the stimulable phosphor is first exposed to a radiation passing through an object to have a radiation image stored therein, and is then scanned with stimulating rays which cause it to emit light in proportion to the stored radiation energy. The light emitted from the stimulable phosphor sheet when the sheet is exposed to the stimulating rays is photoelectrically detected and converted to an electric image signal, which is processed as desired to reproduce a visible image having an improved quality, particularly a high diagnostic efficiency and accuracy. The finally obtained visible image may be reproduced in the form of a hard copy or may be displayed on a cathode ray tube (CRT). After the light emitted by the stimulable phosphor sheet is detected, radiation energy remaining in the sheet may be released for reuse of the sheet by the method as described, for example, in Japanese Unexamined Pat. Publication No. 56(1981)-12599 and U.S. Pat. No. 4,400,619.

However, when the stimulable phosphor sheet is reused as described above, fine dust floating in the ambient air or arising in the radiation image recording apparatus or the read-out apparatus may stick to the surface of the stimulable phosphor sheet. When dust sticks to the surface on the stimulable phosphor side of the sheet, light emission from the dust sticking portion of the sheet is interrupted by the dust during radiation image read-out, and the portion appears as a blank in a reproduced image. For example, in the radiation image of a cancer source, an object portion calcified by the cancer often appears as a blank in the radiation image. Also, for other diseases, object portions affected by the disease appear as blanks in the radiation images. Therefore, when the image blank is caused by dust, the blank portion is mistaken as a portion affected by a disease.

SUMMARY OF THE INVENTION

The primary object of the present invention is to provide a stimulable phosphor sheet cleaning apparatus which efficiently removes dust from a stimulable phosphor sheet.

Another object of the present invention is to provide a stimulable phosphor sheet cleaning apparatus which assures a radiation image having a high image quality, particularly a high diagnostic efficiency and accuracy.

The present invention provides a stimulable phosphor sheet cleaning apparatus for removing dust sticking to a surface of a stimulable phosphor sheet used for recording a radiation image, which comprises:

(i) a first sheet conveying means for conveying said stimulable phosphor sheet, (ii) a rotatable cleaning roll provided with a cleaning member for catching said dust around the circumferential surface and positioned for contact with the surface of said stimulable phosphor sheet conveyed by said first sheet conveying means, (iii) a plurality of guide rolls for guiding said stimulable phosphor sheet so that it contacts in the bent form with said circumferential surface of said cleaning roll, and (iv) a second sheet conveying means for conveying said stimulable phosphor sheet coming from said cleaning roll.

The first sheet conveying means may comprise a pair of rolls, and the cleaning member be felt, velvet, fur or the like.

The stimulable phosphor sheet is fabricated to exhibit moderate rigidity and resiliency by use of a synthetic resin or the like as the base. Therefore, when the sheet is contacted with the cleaning roll in the bent form by the guide rolls, the sheet closely contacts the cleaning roll by its rigidity and resiliency, and dust on the surface of the sheet is efficiently removed by the cleaning roll.

In the cleaning apparatus of the present invention, since dust sticking to the surface of the stimulable phosphor sheet is efficiently removed, it is possible to prevent generation of a blank which is mistaken as a portion affected by disease in the radiation image reproduced from the stimulable phosphor sheet, and to obtain a radiation image having an improved image quality, particularly a high diagnostic efficiency and accuracy.

DESCRIPTION OF THE PREFERRED EMBODIMENTS

The present invention will hereinbelow be described in further detail with reference to the accompanying drawings.

Figure 1:
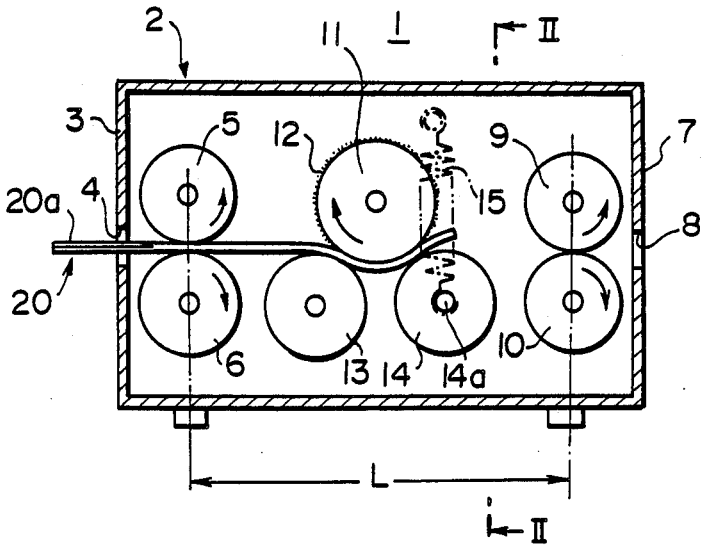
FIG. 1 is a partially cutaway side view showing an embodiment of the cleaning apparatus in accordance with the present invention.
Figure 2:
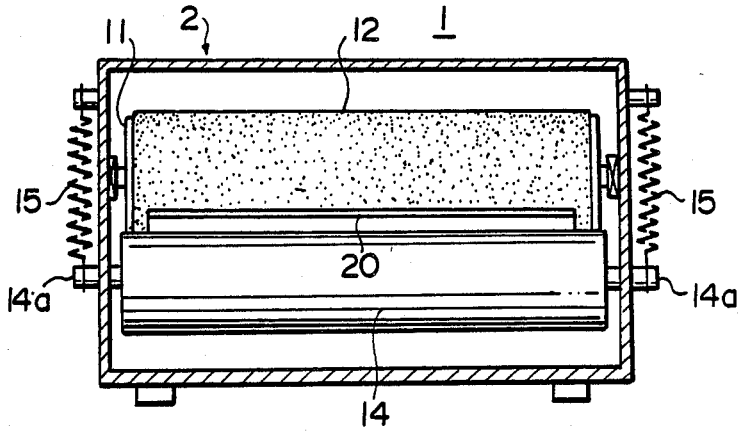
FIG. 2 is a sectional view taken along line II—II of FIG. 1.

FIGS. 1 and 2 show an embodiment of the stimulable phosphor sheet cleaning apparatus in accordance with the present invention. As shown in FIG. 1, a case 2 of a cleaning apparatus 1 has a front plate 3 provided with a sheet inlet 4, and a pair of first sheet conveying rolls 5 and 6 rotated in the direction as indicated by the arrow are positioned inside of the sheet inlet 4. Also, the case 2 has a rear plate 7 provided with a sheet outlet 8, and a pair of second sheet conveying rolls 9 and 10 rotated in the direction as indicated by the arrow are positioned inside of the sheet outlet 8. The distance L between the nip point of the first sheet conveying rolls 5, 6 and the nip point of the second sheet conveying rolls 9, 10 is adjusted to be shorter than the whole length of a stimulable phosphor sheet 20 cleaned by the cleaning apparatus 1.

A cleaning roll 11 rotated in the direction as indicated by the arrow is positioned between the first sheet conveying rolls 5, 6 and the second sheet conveying rolls 9, 10. The circumferential surface of the cleaning roll 11 is covered by a cleaning member 12 made of felt, velvet, fur or the like. Free rolls 13 and 14 acting as guide rolls are positioned in spaced relation to each other under the cleaning roll 11 so that a line contacting the circumferential surfaces of the free rolls 13 and 14 on the cleaning roll 11 side is above the lower end level of the circumferential surface of the cleaning roll 11. The free roll 14 positioned closer to the second sheet conveying rolls 9 and 10 has a rotation shaft 14*a* supported for vertical movement. The free roll 14 is urged towards the cleaning roll 11 by a pull spring 15 having an upper end engaged with the case 2 and a lower end engaged with the rotation shaft 14*a* of the free roll 14.

Figure 3:
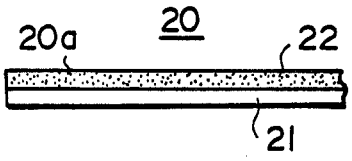
FIG. 3 is a side view showing the stimulable phosphor sheet cleaned by the cleaning apparatus of FIG. 1, and FIGS. 4 and 5 are partially cutaway side views showing further embodiments of the cleaning apparatus in accordance with the present invention.

Operations and effects of the cleaning apparatus 1 will hereinbelow be described. As shown in FIG. 3, the stimulable phosphor sheet 20 to be cleaned comprises a base 21 fabricated of a synthetic resin and a stimulable phosphor layer 22 overlaid on the base 21. As shown in FIG. 1, the stimulable phosphor sheet 20 is introduced into the cleaning apparatus 1 from the sheet inlet 4 with a surface 20*a* on the stimulable phosphor layer 22 side of the sheet 20 facing up. When the cleaning apparatus 1 is operated, the first sheet conveying rolls 5 and 6, the second sheet conveying rolls 9 and 10, and the cleaning roll 11 are rotated by a drive unit (not shown) in the aforesaid directions. The forward end of the stimulable phosphor sheet 20 introduced into the cleaning apparatus 1 is sandwiched between the first sheet conveying rolls 5 and 6, and the sheet 20 is conveyed towards the center of the cleaning apparatus 1. The forward end of the stimulable phosphor sheet 20 thus conveyed advances on the free roll 13 and contacts the circumferential surface of the cleaning roll 11. Then the forward end of the stimulable phosphor sheet 20 is moved along the circumferential surface of the cleaning roll 11 to the lower side thereof, and contacts the circumferential surface of the free roll 14. The stimulable phosphor sheet 20 is thus guided by the free roll 14 and passed between the free roll 14 and the cleaning roll 11. Since the free rolls 13, 14 and the cleaning roll 11 are positioned in the aforesaid relation to each other, when the forward end of the stimulable phosphor sheet 20 advances to the nip point between the free roll 14 and the cleaning roll 11, the sheet 20 is bent and the surface 20*a* thereof contacts the cleaning member 12 of the cleaning roll 11 in the bent form. As described above, the base 21 of the stimulable phosphor sheet 20 is fabricated of a synthetic resin and the sheet 20 exhibits moderate rigidity and resiliency. Therefore, the stimulable phosphor sheet 20 closely contacts the cleaning roll 11 when it is bent.

As the stimulable phosphor sheet 20 is conveyed by the first sheet conveying rolls 5 and 6 and advances in contact with the cleaning member 12 of the rotated cleaning roll 11, dust sticking to the surface 20*a* of the stimulable phosphor sheet 20 is caught by the cleaning member 20 and removed thereby from the surface 20*a*. Since the stimulable phosphor sheet 20 closely contacts the cleaning member 12 of the cleaning roll 11 because of the rigidity and resiliency of the sheet 20 and by the upwardly urged free roll 14, dust is efficiently removed by the cleaning member 12 from the surface 20*a* of the sheet 20. Before the stimulable phosphor sheet 20 is disengaged from the first sheet conveying rolls 5 and 6, the forward end of the sheet 20 is sandwiched between the second sheet conveying rolls 9 and 10, and the sheet 20 is continuously conveyed thereby. When the stimulable phosphor sheet 20 has completely passed under the cleaning roll 11, the whole area of the sheet surface 20*a* is cleaned.

The free roll 14 need not necessarily be urged towards the cleaning roll 11. However, it should preferably be urged towards the cleaning roll 11 to improve the cleaning effects. Also, in the aforesaid embodiment, the free rolls 13 and 14 are used as guide rolls for guiding the stimulable phosphor sheet 20 in the bent form. The guide rolls may be rotated at the same speed as those of the first sheet conveying rolls 5, 6 and the second sheet conveying rolls 9, 10.

Figure 4:
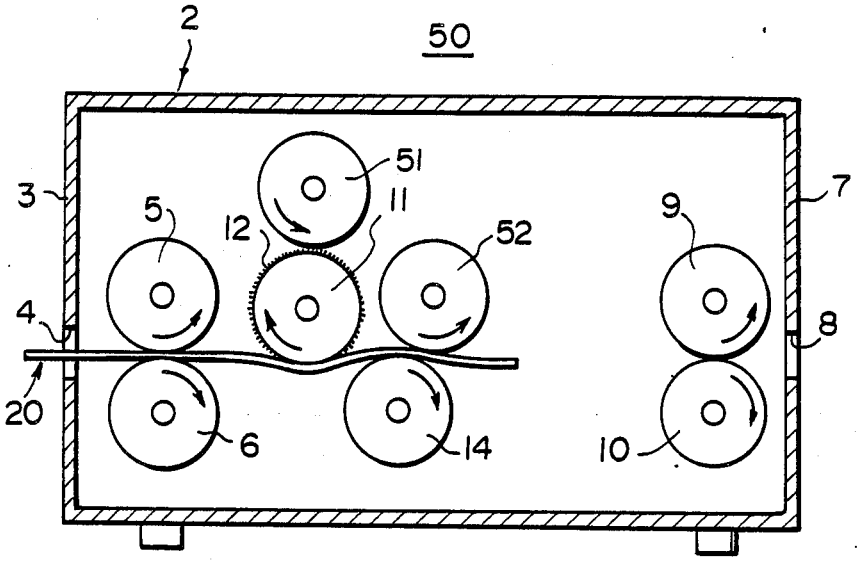

FIG. 4 shows another embodiment of the cleaning apparatus in accordance with the present invention. In FIG. 4, similar elements are numbered with the same reference numerals with respect to FIGS. 1 and 2. (This also applies to FIG. 5.) In a cleaning apparatus 50, the cleaning roll 11 is positioned comparatively close to the first sheet conveying rolls 5 and 6, and the stimulable phosphor sheet 20 is guided to contact the cleaning roll 11 in the bent form by the free roll 14 and the sheet conveying roll 6. Namely, in this embodiment, the sheet conveying roll 6 acts as one of the two guide rolls for guiding the stimulable phosphor sheet 20.

Also, in the embodiment of FIG. 4, an adhesive roll 51 having a circumferential surface provided with an adhesive layer is positioned to contact the cleaning member 12 of the cleaning roll 11. Dust caught by the cleaning member 12 adheres to the adhesive roll 51 and is removed from the cleaning roll 11. Therefore, the sheet cleaning effects are further improved. In order to remove dust from the cleaning member 12, it is also possible to contact a blade with the cleaning member 12 for scraping dust from the cleaning member 12. In FIG. 4, reference numeral 52 denotes a guiding and conveying roll for guiding and conveying the stimulable phosphor sheet 20 to the second sheet conveying rolls 9 and 10.

Figure 5:
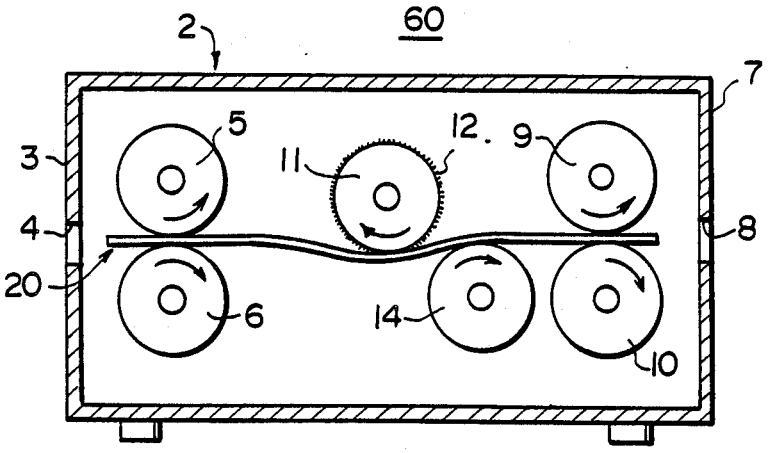

FIG. 5 shows a further embodiment of the cleaning apparatus in accordance with the present invention. In a cleaning apparatus 60, the cleaning roll 11 is positioned comparatively close to the second sheet conveying rolls 9 and 10. In this case, the guiding and conveying roll 52 used in the embodiment of FIG. 4 may be omitted. Also, when the cleaning roll 11 and the second sheet conveying rolls 9, 10 are positioned close to each other, a guide roll like the free roll 13 in FIG. 1 may be positioned on the first sheet conveying roll (5, 6) side of the cleaning roll 11, and the second sheet conveying roll 10 may be used as a guide roll for making the stimulable phosphor sheet 20 contact the cleaning roll 11 in the bent form together with said guide roll positioned on the first sheet conveying roll (5, 6) side of the cleaning roll 11.

The number of the guide rolls for guiding the stimulable phosphor sheet to contact the cleaning roll is not limited to two, and three or more guide rolls may be used.

The stimulable phosphor sheet cleaning apparatus of the present invention may be fabricated as a separate unit of the cleaning apparatus, or may be combined with the radiation image read-out apparatus so that the stimulable phosphor sheet 20 ejected from the second sheet conveying rolls 9 and 10 is sent to a sheet conveyance system of the radiation image read-out apparatus and the sheet 20 is always cleaned immediately before image read-out. Of course, cleaning of the stimulable phosphor sheet may be conducted at any time. However, since dust on the surface of the stimulable phosphor sheet adversely affects the radiation image read-out, cleaning should preferably be conducted immediately before the image read-out.

We claim:

1. A stimulable phosphor sheet cleaning apparatus for removing dust sticking to a surface of a stimulable phosphor sheet used for recording a radiation image, said sheet traveling through a substantially linear path from an upstream end of said apparatus toward a downstream end of said apparatus, said apparatus comprising:

(i) a first sheet conveying means for conveying said stimulable phosphor sheet, (ii) a rotatable cleaning roll provided with a cleaning member for catching said dust around the circumferential surface and positioned for contact with the surface of said stimulable phosphor sheet conveyed by said first sheet conveying means, (iii) a plurality of guide rolls for guiding said stimulable phosphor sheet, each having a periphery and being positioned such that the periphery of the guide rolls are substantially spaced from one another such that a portion of the stimulable phosphor sheet between nip points between the cleaning roll and respective guide rolls is in a bent form to provide a substantial contact of the sheet with the circumferential surface of the cleaning roll, and (iv) a second sheet conveying means for conveying said stimulable phosphor sheet coming from said cleaning roll.

2. An apparatus as defined in claim 1 wherein each of said first sheet conveying means and said second sheet conveying means comprises a pair of rotatable rolls.

3. An apparatus as defined in claim 1 wherein said cleaning member is fabricated of a material selected from the group consisting of felt, velvet and fur.

4. An apparatus as defined in claim 1 wherein one of said plurality of guide rolls is urged by a pull spring towards said cleaning roll.

5. An apparatus as defined in claim 1 wherein said cleaning roll is positioned comparatively close to said first sheet conveying means, and said first sheet conveying means is used also as one of said plurality of guide rolls.

6. An apparatus as defined in claim 1 wherein an adhesive roll having a circumferential surface provided with an adhesive layer is positioned to contact said cleaning member of said cleaning roll.

7. An apparatus as defined in claim 1 wherein said cleaning roll is positioned comparatively close to said second sheet conveying means, and said second sheet conveying means is used also as one of said plurality of guide rolls.

8. A stimulable phosphor sheet cleaning apparatus for removing dust sticking to a surface of a stimulable phosphor sheet used for recording a radiation image, said sheet traveling through a substantially linear path from an upstream end of said apparatus toward a downstream end of said apparatus, said apparatus comprising:

(i) a first sheet conveying means provided at the upstream end of said apparatus for conveying said stimulable phosphor sheet, (ii) a rotatable cleaning roll provided with a cleaning member for catching said dust around the circumferential surface and positioned for contact with the surface of said stimulable phosphor sheet, said cleaning roll positioned downstream of said first conveying means and having a periphery offset from said linear path in a first direction, (iii) a plurality of guide rolls for guiding said stimulable phosphor sheet, said guide rolls providing a nip point therebetween which is offset from the periphery of the cleaning roll in a second direction opposite to said first direction so as to provide contact of said sheet in a bent form with the circumferential surface of said cleaning roll, said nip point being downstream of said cleaning roll, and (iv) a second sheet conveying means for conveying said stimulable phosphor sheet coming from said cleaning roll.

9. An apparatus as defined in claim 8 wherein each of said first sheet conveying means and said second sheet conveying means comprises a pair of rotatable rolls.

10. An apparatus as defined in claim 8 wherein said cleaning member is fabricated of a material selected from the group consisting of felt, velvet and fur.

11. An apparatus as defined in claim 8 wherein one of said plurality of guide rolls is urged by a pull spring towards said cleaning roll.

12. An apparatus as defined in claim 8 wherein said cleaning roll is positioned comparatively close to said first sheet conveying means, and said first sheet conveying means is used also as one of said plurality of guide rolls.

13. An apparatus as defined in claim 8 wherein an adhesive roll having a circumferential surface provided with an adhesive layer is positioned to contact said cleaning member of said cleaning roll.

14. An apparatus as defined in claim 8 wherein said cleaning roll is positioned comparatively close to said second sheet conveying means, and said second sheet conveying means is used also as one of said plurality of guide rolls.

15. A stimulable phosphor sheet cleaning apparatus for removing dust sticking to a surface of a stimulable phosphor sheet used for recording a radiation image, said sheet traveling through a substantially linear path from an upstream end of said apparatus toward a downstream end of said apparatus, said apparatus comprising:

(i) a first sheet conveying means for conveying said stimulable phosphor sheet, (ii) a rotatable cleaning roll provided with a cleaning member for catching said dust around the circumferential surface and positioned for contact with the surface of said stimulable phosphor sheet conveyed by said first conveying mean, said cleaning roll having a periphery offset from said linear path in a first direction, (iii) a guide roll for guiding said stimulable phosphor sheet, said guide roll having a periphery offset from the periphery of the cleaning roll in a second direction opposite to said first direction such that said sheet contacts the circumferential surface of said cleaning roll in a bent form, and (iv) a second sheet conveying means for conveying said stimulable phosphor sheet coming from said cleaning roll.

16. An apparatus as defined in claim 15 wherein each of said first sheet conveying means and said second sheet conveying means comprises a pair of rotatable rolls.

17. An apparatus as defined in claim 15 wherein said cleaning member is fabricated of a material selected from the group consisting of felt, velvet and fur.

18. An apparatus as defined in claim 15 wherein one of said plurality of guide rolls is urged by a pull spring towards said cleaning roll.

19. An apparatus as defined in claim 15 wherein said cleaning roll is positioned comparatively close to said firs sheet conveying means, and said first sheet conveying means is used also as one of said plurality of guide rolls.

20. An apparatus as defined in claim 15 wherein an adhesive roll having a circumferential surface provided with an adhesive layer is positioned to contact said cleaning member of said cleaning roll.

21. An apparatus as defined in claim 15 wherein said cleaning roll is positioned comparatively close to said second sheet conveying means, and said second sheet conveying means is used also as one of said plurality of guide rolls.

* * * * *